US005867130A

United States Patent [19]

Tay et al.

[11] Patent Number: 5,867,130

[45] Date of Patent: Feb. 2, 1999

[54] DIRECTIONAL CENTER-FED WAVE DIPOLE ANTENNA

[75] Inventors: Roger S. Tay, Sunrise; Quirino Balzano, Plantation, both of Fla.

[73] Assignee: Motorola, Inc., Schaumburg, Ill.

[21] Appl. No.: 811,789

[22] Filed: Mar. 6, 1997

[51] Int. Cl.[6] ..... H01Q 9/28; H01Q 1/38

[52] U.S. Cl. ..... 343/795; 343/700 MS; 343/822

[58] Field of Search ..... 343/795, 700 MS, 343/820, 821, 822; H01Q 9/28, 1/38

[56] References Cited

U.S. PATENT DOCUMENTS

| | | | |
|---|---|---|---|
| 4,298,878 | 11/1981 | Dupressoir et al. | 343/795 |
| 4,401,988 | 8/1983 | Kaloi | 343/700 MS |
| 4,783,666 | 11/1988 | Ast et al. | 343/872 |
| 5,262,791 | 11/1993 | Tsuda et al. | 343/700 MS |
| 5,450,090 | 9/1995 | Gels et al. | 343/700 MS |
| 5,497,164 | 3/1996 | Croq | 343/700 MS |
| 5,561,435 | 10/1996 | Nalbandian et al. | 343/700 MS |
| 5,708,446 | 1/1998 | Laramie | 343/821 |

*Primary Examiner*—Hoanganh Le
*Attorney, Agent, or Firm*—Val Jean F. Hillman

[57] ABSTRACT

A directional center-fed half wave dipole antenna is constructed from a multilayer substrate (100) having dipole antenna elements (112, 142) disposed on opposite surfaces (113, 141) of the multilayer substrate (100). An energy reflector (160) is disposed on at least one side of the substrate (100) and positioned adjacent to the dipole antenna elements (112, 142). The dipole antenna elements (112, 142) are fed by a center feed member (122). Center feed member (122) has a tapered width so as to provide the necessary impedance matching. A ground plane is disposed within the multilayer substrate, the elements of which (114, 134) are positioned on both sides of the center feed element (122).

15 Claims, 4 Drawing Sheets

DIRECTIONAL CENTER-FED WAVE DIPOLE ANTENNA

FIELD OF THE INVENTION

This invention relates generally to antennas, more specifically to micro-strip antenna circuits and particularly to a directional center-fed half wave dipole antenna constructed from a multilayer substrate.

BACKGROUND OF THE INVENTION

For portable communication devices such as, for example, two-way radios, pagers, radio telephones and the like, the prevailing industry trend is toward greater degrees of consumer market penetration. At the same time, the consumer markets are demanding smaller, faster, cheaper radio products. In recent years, in direct response to these market influences, radio components, amplifiers, filters, integrated circuits (ICs) and the like have experienced radical size reductions. The outcome has been a steady reduction in the size of consumer radio products. Unfortunately, similar gains in the antenna art have lagged well behind. Not surprisingly therefore, one of the largest components in a typical radio today is the antenna.

One relatively recent and promising development in the battle to reduce the size of consumer radio products has been the introduction of micro-strip technology into antenna design; namely, affixing miniature resonators on a dielectric substrate having a ground plane. While this approach has proven useful in applications where radiation efficiency is not extremely critical, it will be appreciated by those skilled in the art that the typical micro-strip antennae is not generally very efficient and may even be loosely characterize as a radio frequency (RF) polluter. If these antennas are going to find their way into consumer based products, however, they must be optimized to reduce RF energy deposition and increase radiation efficiency. Based on the foregoing, it would be extremely advantageous to provide a micro-strip antenna system that is inexpensive, easy to manufacture and well suited for use in the consumer market place.

DETAILED DESCRIPTION OF THE PREFERRED EMBODIMENT

Figure 1:
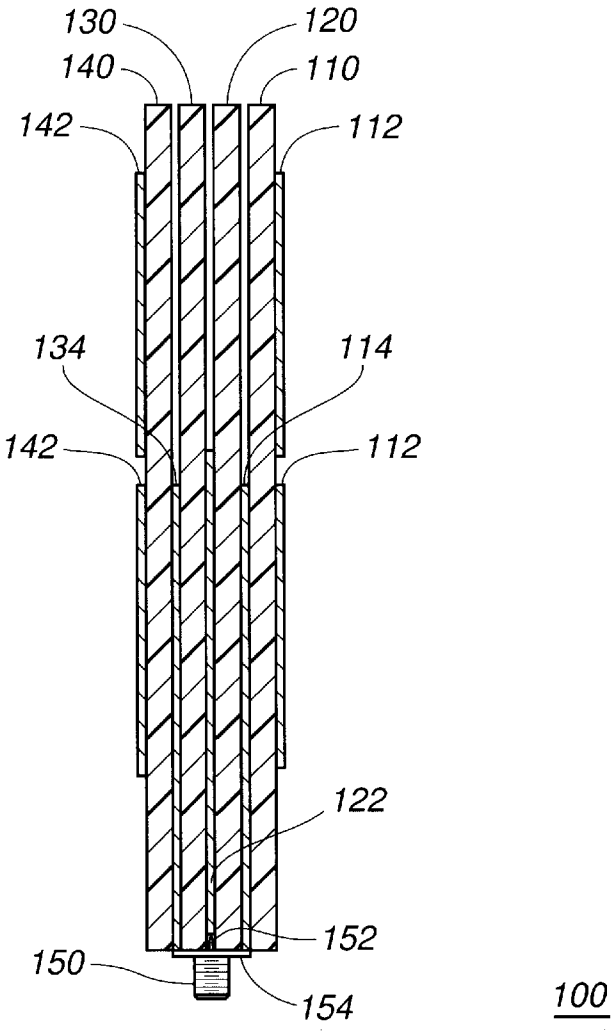
FIG. 1 depicts a cross sectional side view of the antenna in accordance with the present invention.

FIG. 1 depicts a cross sectional side view of a directional center-fed half wave dipole antenna 100 in accordance with the present invention. Using conventional printed circuit board techniques, a metal transmission line is deposited on a surface of a dielectric material layer 120 to form an antenna feed member 122. As visible from FIG. 2, antenna feed member 122 has a tapered width that operates as an impedance transformer, thereby providing an impedance matching capability. The dielectric material is preferably made from a low loss, low dielectric material such as FR4, TEFLON® or other material suitable for use in the printed circuit board art.

Located on another dielectric material layer 130 and positioned adjacent to material layer 120 is a ground plane element 134 comprised of a conductive transmission line providing one half of the antenna ground plane that flanks (i.e., is positioned on both sides of) the impedance transforming feed line 122 in accordance with the present invention. Located on yet another dielectric material layer 140 and positioned adjacent to material layer 130 is a dipole antenna element 142 comprised of two half-wave dipole antenna elements as shown. Located on yet another dielectric material layer 110 positioned adjacent to material layer 120 is a ground plane element 114 comprised of a conductive transmission line providing the second half of the antenna ground plane. Located on the other side of the dielectric layer 110 is a second dipole antenna element 112.

An antenna probe 150 is shown mounted to one side of the antenna 100. Probe 150 has a central conductor 152 and a shield 154. The central conductor 152 is connected to the feed member 122. The shield 154 is connected to ground plane elements 114 and 134. As will be appreciated by those skilled in the art, feed member 122, ground plane 114 and 134, and dipole antenna elements 112 and 142 are transmission lines formed by any number of well known deposition, etch, photolithographic or thin-film processing techniques.

Figure 2:
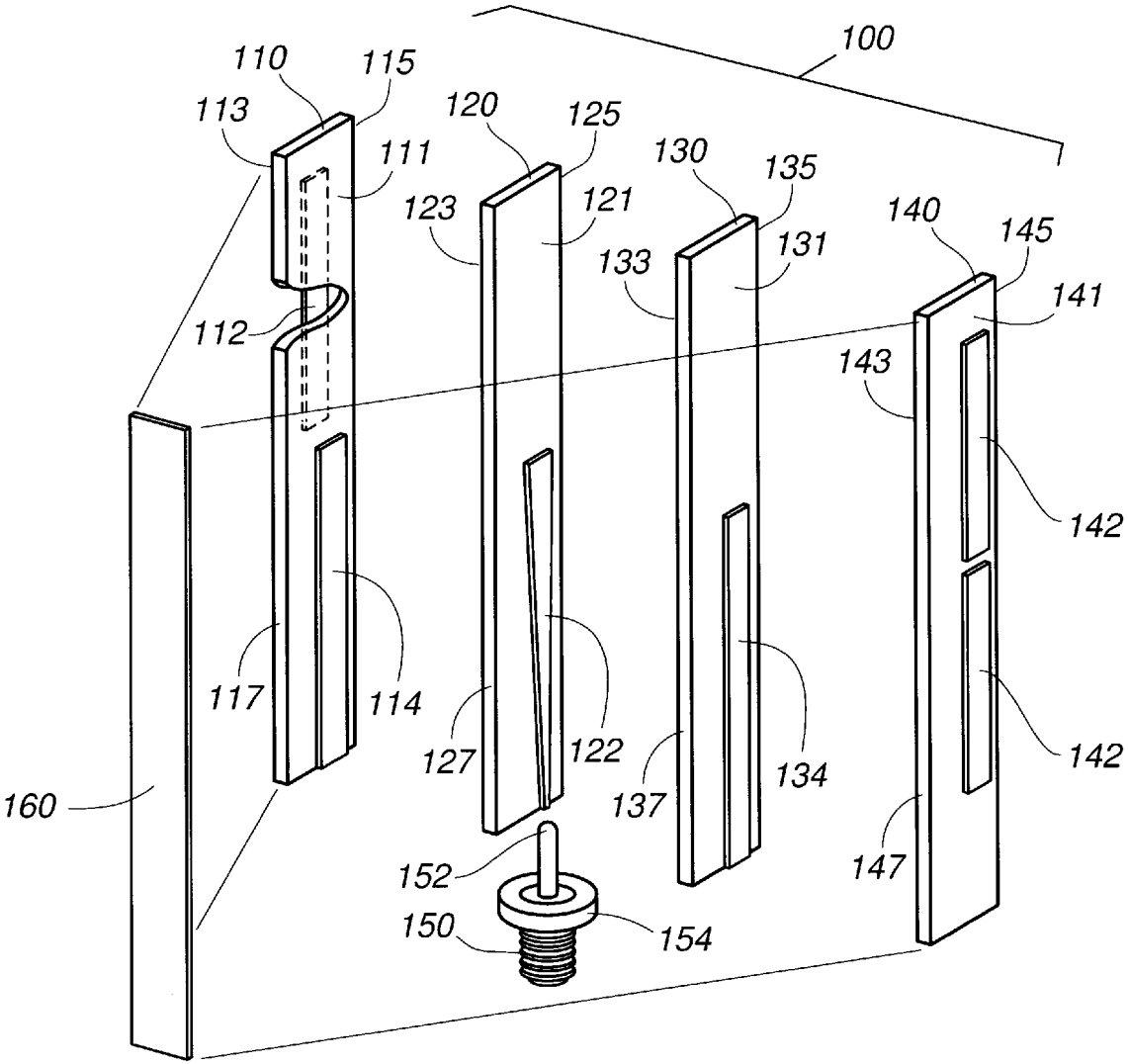
FIG. 2 is a perspective view of the antenna of FIG. 1.

With reference to FIG. 2, there is shown a perspective view of the antenna 100 of FIG. 1. As will be appreciated, upon review thereof, the present invention is a multilayer center-fed half wave dipole antenna 100. In accordance with the preferred embodiment, this multilayer antenna is constructed from a multilayer substrate such as a printed circuit board, and having at least four dielectric material layers 110, 120, 130, and 140.

One such dielectric material layer 110 has a first surface 111 and second surface 113. In accordance with the present invention, the second ground plane element 114 is disposed on the first surface 111 of dielectric material layer 110. In addition the second dipole elements 112 is disposed on the second surface 113 of dielectric material layer 110. Dielectric material layer 110 has at least two sides of interest. The first side 115 is the side closest to the dipole antenna elements 112, while side 117 is the side furthest away from the dipole antenna elements 112. Of note, side 117 is the side along which an energy reflector 160 is located. During operation, energy reflector 160 operates to attenuate radio frequency (RF) energy either transmitted or received in the direction or along the side of the antenna 100 where energy reflector 160 located.

A second dielectric material layer 120 has a first surface 121 and second surface 123. In accordance with the preferred embodiment, the antenna feed member 122 of FIG. 1 is disposed on the first surface 121 of dielectric material layer 120. As depicted, the antenna feed element 122 is a tapered width microstrip transmission line. In addition the dielectric material layer 120 has two sides of interest. The first side 125 is the side closest to the antenna feed element 122 while side 127 is the side furthest away from the antenna feed element 122. Of note, side 127 is the side along which energy reflector 160 is located.

A third dielectric material layer 130 has a first surface 131 and a second surface 133. In accordance with the preferred embodiment, the second ground plane element 134 of FIG. 1 is disposed on the first surface 131 of dielectric material layer 140. In addition the dielectric material layer 130 has two sides of interest. The first side 135 is the side closest to the ground plane elements 134 while side 137 is the side furthest away from the ground plane element 134. Of note, side 137 is the side along which energy reflector 160 is located.

The fourth and final dielectric material layer 140, in accordance with the preferred embodiment, has a first surface 141 and second surface 143. In accordance with the present invention, the second dipole antenna element 142 are disposed on the first surface 141 of dielectric material layer 140. Like the previous dielectric material layers, the material layer 140 has at least two sides of interest. The first side 141 is the side closest to the dipole antenna elements 142 while side 147 is the side furthest away from the dipole antenna elements 142. Of note, side 147 is the side along which energy reflector 160 is located.

To complete the antenna structure, plated through holes and/or conductive vias (not shown) are employed to electrically connect center feed member 122 to the dipole antenna elements 112 and 142 on opposite surfaces of the multilayer dielectric substrate 100. In a similar fashion ground plane elements 114 and 134, disposed on both sides of center feed member 122, are electrically connected together to provide a ground plane that flanks center feed member 122. Finally, the antenna is equipped with a probe 150 having a central conductor 152 and shield 154. The probe 150 is mounted to the substrate with its shield 154 in contact with ground plane elements 114 and 134 and its central conductor 152 in electrical contact with the tapered center feed member 122.

Figure 3:
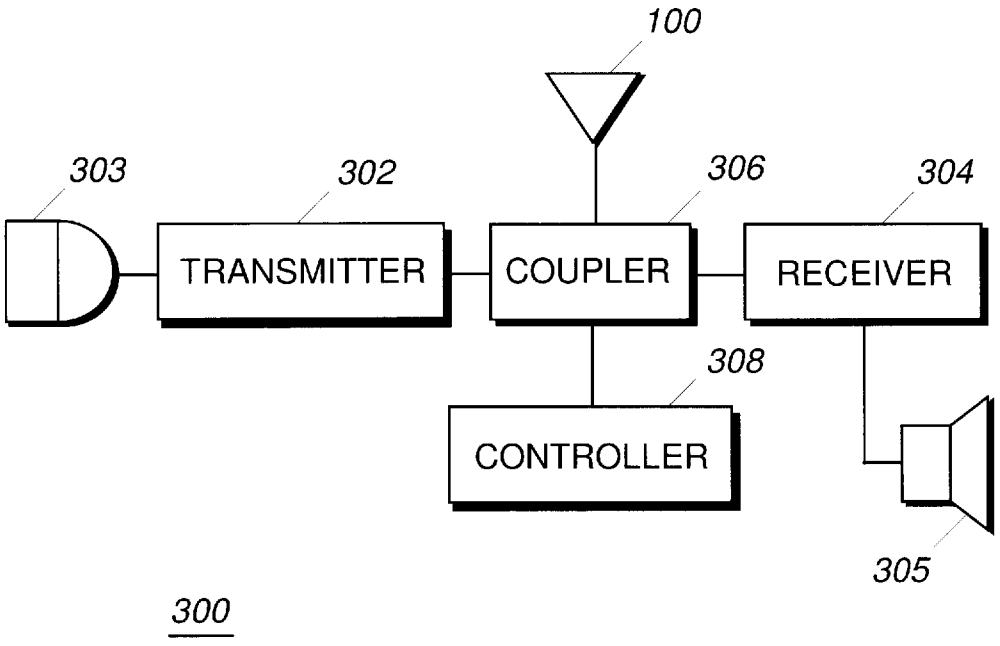
FIG. 3 is a block diagram of a communications device using the antenna of FIG. 1.

As previously, mentioned, the invention is a directional multilayer center fed half-wave dipole antenna. Such a device is a linearly polarized antenna anticipated for use with hand held communications devices such as two-way portable radios, radiotelephones, pagers and the like. With reference to FIG. 3, a block diagram of a communications device 300 of the type anticipated for use by the present invention is depicted.

With reference to FIG. 3, communications device 300 employs a transmitter 302 which operates to transmit signals received from microphone 303. A receiver 304 couples received signals to speaker 305. The antenna 100 of the present invention is coupled to the transmitter 302 and the receiver 304 through coupler 306. As will be appreciated, coupler 306 provides switched operations between transmitter 302 and receiver 304 under the direction of controller 308.

As will be appreciated by those skilled in the art after review hereof, the directional nature of the antenna 100 is due in part to the use of the energy reflector 160 of FIG. 2 which operates to attenuate the RF energy transmitted from or received by the antenna 100 along the edge where the reflector 160 is located. The fact that the antenna 100 is directional operates to improve the effective radiation efficiency of the antenna in the direction away from energy reflector 160. When used in association with hand held communications devices, improvement is readily visible.

Figure 4:
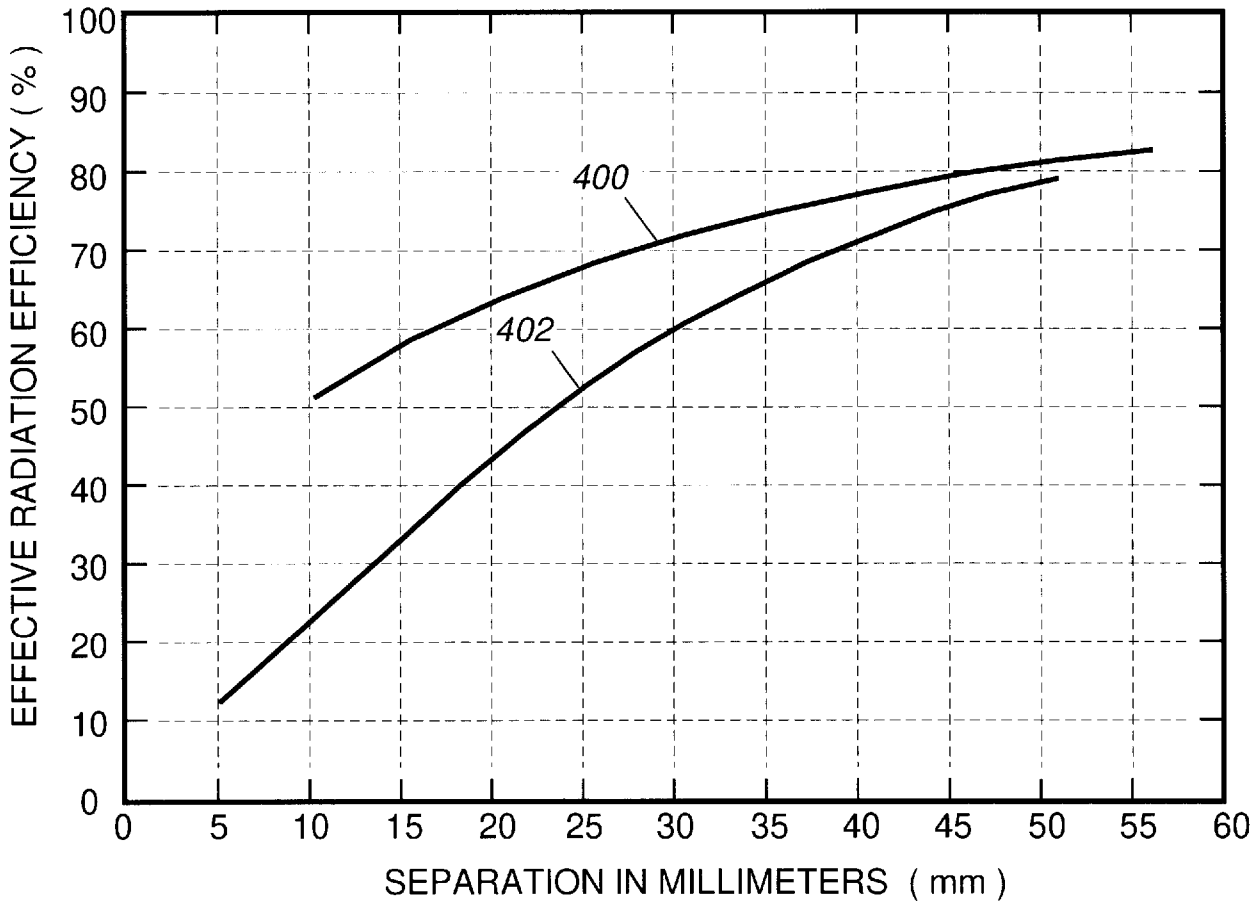
FIG. 4 is a graph illustrating the radiation efficiency of the antenna of FIG. 1 when compared to the prior art.

FIG. 4 is a graph illustrating the radiation efficiency of the antenna of the present invention as compared to a prior art half-wave dipole antenna. When the antenna of the present invention is held in the normal hand held device operating position; namely, near the operator's face during transmission and near the operator's ear during reception, it is seen from plot 400 that the present invention provides a better than forty percent (40%) increase in the usable radiation efficiency at distances between 15-to-25 millimeters (mm) from the operator. As the device is held at distances further away from the operator, the percent increase in the usable radiation efficiency declines. Notwithstanding, the antenna of the present invention operates to consistently provide a greater usable radiation efficiency than a prior art half-wave dipole antenna as shown by plot 402 and out to a distance of 50 mm away from the operator. Herein lies the primary advantages of the present invention over the prior art; namely, the energy reflector 160 of FIG. 2 attenuates the transmission and reception of radio frequency (RF) energy along the edge of the substrate where the energy reflector 160 is located thereby increasing the percent of usable radiation efficiency in the direction away from the energy reflector 160. As will be appreciated by those skilled in the art, such an antenna design will operate to increase the radiation efficiency of a communications device used in association therewith.

What is claimed is:

1. A directional center-fed half wave dipole antenna comprising:

a multilayer dielectric substrate having a first and a second surface, an edge, and first and second dipole elements disposed on the first and the second surfaces thereof, respectively;

a center feed member disposed within the multilayer dielectric substrate;

a ground plane disposed within the multilayer dielectric substrate and positioned on both sides of the center feed member; and an energy reflector disposed along the edge of the multilayer dielectric substrate.

2. The antenna of claim 1, wherein the first and second dipole elements are electrically connected to the center feed member.

3. The antenna of claim 1, wherein ground planes elements positioned on both sides of the center feed member are electrically connected.

4. The antenna of claim 1, wherein the center feed member comprises an impedance transformer.

5. The antenna of claim 4, wherein the impedance transformer is a taper in the center feed member.

6. The antenna of claim 4, wherein the impedance transformer is a tapered width microstrip transmission line.

7. The antenna of claim 1, wherein the center feed member and the dipole elements are microstrip transmission lines.

8. The antenna of claim 1, wherein the energy reflector is a microstrip transmission line disposed along the edge of the multilayer substrate.

9. The antenna of claim 1, wherein the multilayer substrate is a printed circuit board.

10. The antenna of claim 1, wherein the energy reflector attenuates the transmission and reception of radio frequency (RF) energy along the edge of the substrate where the energy reflector is located.

11. A communications device for transmitting and receiving radio frequency (RF) signals comprising:

a transceiver for transmitting and receiving RF signals; and a directional multilayer center-fed half wave dipole antenna, coupled to the transceiver, comprising:

a first dielectric material layer having a first and second surface, at least one side, a ground plane element disposed on the first surface thereof, and a first dipole element disposed on the second surface thereof;

a second dielectric material layer having a first and second surface, at least one side, and an antenna feed member disposed on the first surface thereof;

a third dielectric material layer having a first and second surface, at least one side, and a ground plane element disposed on the first surface thereof;

a fourth dielectric material layer having a first and second surface, at least one side, and a second dipole element disposed on the first surface thereof;

an energy reflector disposed along the at least one side of the first, second, third, and fourth dielectric material layers; and a probe having a central conductor and shield, said probe mounted to the substrate with the shield in electrical contact with the ground plane elements and the central conductor in electrical contact with the antenna feed member.

12. The antenna of claim 11, wherein the first and second dipole elements are electrically connected to the antenna feed member.

13. The antenna of claim 11, wherein the ground plane elements are positioned on both sides of the antenna feed member.

14. The antenna of claim 11, wherein the antenna feed member comprises an impedance transformer.

15. The antenna of claim 14, wherein the impedance transformer is a tapered width microstrip transmission line.

* * * * *